US012662274B2

(12) United States Patent
Fukuda et al.

(10) Patent No.: US 12,662,274 B2
(45) Date of Patent: Jun. 23, 2026

(54) AUTOMATIC BUNDLING TOOL DEVICE

(71) Applicant: HellermannTyton GmbH &Co. KG, Tornesch (DE)

(72) Inventors: Taro David Fukuda, Rastede (DE); Hagen Spiess, Hamburg (DE)

(73) Assignee: HellermannTyton GmbH & Co. KG, Tornesch (DE)

( * ) Notice: Subject to any disclaimer, the term of this patent is extended or adjusted under 35 U.S.C. 154(b) by 455 days.

(21) Appl. No.: 18/299,477

(22) Filed: Apr. 12, 2023

(65) Prior Publication Data

US 2023/0331412 A1 Oct. 19, 2023

(30) Foreign Application Priority Data

Apr. 14, 2022 (DE) ..... 202022102045.0

(51) Int. Cl.
*B65B 57/04* (2006.01)
*B65B 13/02* (2006.01)
(Continued)

(52) U.S. Cl.
CPC ..... *B65B 13/04* (2013.01); *B65B 13/027* (2013.01); *B65B 13/22* (2013.01); *B65B 57/04* (2013.01)

(58) Field of Classification Search
CPC ..... B65B 13/04; B65B 13/025; B65B 13/02; B65B 13/185; B65B 13/22; B65B 13/186;
(Continued)

(56) References Cited

U.S. PATENT DOCUMENTS 3,865,156 A 2/1975 Moody et al.
4,178,973 A 12/1979 Collier et al.
(Continued)

FOREIGN PATENT DOCUMENTS

CN 1100054 3/1995
CN 0722885 7/1996
(Continued)

OTHER PUBLICATIONS

"Notice of Allowance", U.S. Appl. No. 18/049,821, filed Aug. 9, 2023, 8 pages.
(Continued)

*Primary Examiner* — Jimmy T Nguyen
(74) *Attorney, Agent, or Firm* — Colby Nipper PLLC

(57) ABSTRACT

Apparatuses and methods that improve production processes in which automatic bundling tool devices (ABT) bundle a good by one-piece-ties (OPT). The improvements include an ABT for bundling a bundle good with a OPT, which includes a band part end and a head part. The ABT includes a guiding device and a tensioning device configured to tension the OPT. The tensioning device is further configured to push the OPT band part end against the tensioning direction in a pushing direction after the OPT has been tensioned. The ABT further includes a control device configured to determine a characteristic parameter for the pushing of the OPT band part end against the tensioning direction and output a quality check signal as a function of the characteristic parameter for the pushing against the tensioning direction and a reference value predetermined for the characteristic parameter.

20 Claims, 2 Drawing Sheets

(51) Int. Cl.
*B65B 13/04* (2006.01)
*B65B 13/22* (2006.01)

(58) Field of Classification Search
CPC ..... B65B 13/027; B65B 13/18; B65B 13/08; B65B 27/00; B65B 27/10; B65B 57/00; B65B 57/02; B65D 63/16
See application file for complete search history.

(56) References Cited

U.S. PATENT DOCUMENTS 4,371,010 A 2/1983 Hidassy
4,495,972 A 1/1985 Walker
4,516,488 A 5/1985 Bartzick et al.
4,534,817 A 8/1985 O'Sullivan
4,790,225 A * 12/1988 Moody ..... B65B 13/027 206/346
4,793,385 A 12/1988 Dyer et al.
D306,390 S 3/1990 Dyer
4,997,011 A 3/1991 Dyer et al.
5,205,328 A 4/1993 Johnson
5,287,802 A 2/1994 Pearson
5,417,252 A 5/1995 Kurmis
5,492,156 A 2/1996 Dyer et al.
5,595,220 A 1/1997 Leban et al.
5,769,133 A 6/1998 Dyer et al.
5,809,873 A 9/1998 Chak et al.
5,845,681 A 12/1998 Kurmis
5,909,751 A 6/1999 Teagno
5,915,425 A 6/1999 Nilsson et al.
5,921,290 A 7/1999 Dyer et al.
6,019,143 A 2/2000 Marik et al.
D430,781 S 9/2000 Hillegonds
6,119,734 A 9/2000 Kurmis
6,206,053 B1 3/2001 Hillegonds
6,302,157 B1 10/2001 Deschenes et al.
6,354,336 B1 3/2002 Leban
6,401,766 B1 6/2002 Ishikawa
6,497,258 B1 12/2002 Flannery et al.
D473,773 S 4/2003 Hillegonds et al.
6,543,341 B2 4/2003 Lopez
D491,430 S 6/2004 Magno et al.
6,751,828 B2 6/2004 Matschiner et al.
6,840,289 B2 1/2005 Hillegonds
D510,244 S 10/2005 Magno et al.
6,981,528 B2 1/2006 Bartholomew
7,124,787 B2 10/2006 Lueschen
7,165,379 B1 1/2007 Lai
7,210,506 B2 5/2007 Magno
7,216,679 B2 5/2007 Magno et al.
D543,811 S 6/2007 Lueschen
7,231,944 B2 6/2007 Magno et al.
D547,626 S 7/2007 Lueschen et al.
7,299,830 B2 11/2007 Levin et al.
7,422,037 B2 9/2008 Levin et al.
7,591,451 B2 9/2009 Dyer et al.
8,240,343 B2 8/2012 Dyer et al.
D692,738 S 11/2013 Dyer
8,955,556 B2 2/2015 Myers et al.
8,960,241 B2 2/2015 Dyer
D732,361 S 6/2015 Dyer
D755,029 S 5/2016 Myers et al.
D758,155 S 6/2016 Kruzel
9,394,067 B2 7/2016 Dyer
9,394,068 B2 7/2016 Dyer
9,481,102 B1 11/2016 Hojnacki et al.
9,550,590 B2 1/2017 Dyer
9,586,708 B2 * 3/2017 Finzo ..... B65B 13/185
9,694,924 B2 7/2017 Myers et al.
9,701,428 B2 7/2017 Welby et al.
D818,787 S 5/2018 Kitago
10,259,604 B2 4/2019 Myers
D856,101 S 8/2019 Kitago
D878,177 S 3/2020 Kitago
D885,861 S 6/2020 Ni
11,008,123 B2 5/2021 Kitago
11,008,124 B2 5/2021 Kitago
11,027,902 B2 6/2021 Geiger et al.
11,377,241 B2 7/2022 Itatools et al.
11,511,894 B2 11/2022 Hempe et al.
11,827,394 B2 11/2023 Hempe et al.
D1,012,641 S 1/2024 Dyer
12,157,240 B2 12/2024 Dyer
12,258,155 B2 3/2025 Fukuda et al.
12,583,640 B2 3/2026 Schwinn et al.
2002/0093211 A1 7/2002 Filipiak et al.
2002/0108664 A1 8/2002 Kurmis
2002/0108665 A1 8/2002 Thieme
2002/0108666 A1 8/2002 Kurmis
2002/0108667 A1 8/2002 Thieme
2002/0108668 A1 8/2002 Thieme
2002/0129866 A1 9/2002 Czebatul et al.
2003/0136278 A1 7/2003 Miyazaki et al.
2004/0079436 A1 4/2004 Hillegonds
2004/0244606 A1 12/2004 Haberstroh et al.
2004/0244866 A1 12/2004 Ishikawa et al.
2005/0178460 A1 8/2005 Magno
2005/0178461 A1 8/2005 Magno et al.
2006/0011254 A1 1/2006 Yokochi et al.
2006/0037661 A1 2/2006 Lueschen
2007/0157555 A1 7/2007 Tanner
2007/0199610 A1 8/2007 Itagaki
2008/0193230 A1 8/2008 Dear
2009/0121069 A1 5/2009 Dyer et al.
2013/0167969 A1 7/2013 Myers et al.
2013/0167970 A1 7/2013 Dyer
2015/0053300 A1 2/2015 Myers et al.
2015/0151862 A1 6/2015 Kitago
2015/0239588 A1 8/2015 Kitago
2016/0016682 A1 1/2016 Boss et al.
2016/0046398 A1 2/2016 Neeser et al.
2016/0075456 A1 3/2016 Nomura et al.
2016/0167813 A1 6/2016 Myers
2016/0230907 A1 8/2016 Kitago
2016/0280405 A1 9/2016 Thieme et al.
2017/0057674 A1 3/2017 Myers
2017/0174374 A1 6/2017 Figiel et al.
2017/0334587 A1 11/2017 McFall et al.
2019/0106231 A1 4/2019 Schwinn et al.
2019/0127095 A1 5/2019 Kitago
2019/0144149 A1 5/2019 Dohrmann et al.
2019/0210749 A1 7/2019 Kitago
2019/0248521 A1 8/2019 Hillegonds et al.
2020/0391891 A1 12/2020 Xu
2021/0024235 A1 1/2021 Xu
2021/0094713 A1 4/2021 Hempe et al.
2023/0060775 A1 3/2023 Hempe et al.
2023/0104154 A1 4/2023 Fukuda et al.
2023/0128208 A1 4/2023 Dyer
2024/0116661 A1 4/2024 Schwinn et al.

FOREIGN PATENT DOCUMENTS

CN 1572657 2/2005
CN 1660675 8/2005
CN 101486385 7/2009
CN 101585419 11/2009
CN 101983159 3/2011
CN 102275649 A 12/2011
CN 102859821 1/2013
CN 202670128 1/2013
CN 104870315 8/2015
CN 105059581 11/2015
CN 105916774 A 8/2016
CN 106742178 X 5/2017
CN 206579887 10/2017
CN 108791998 11/2018
CN 109250221 A 1/2019
CN 112550799 3/2021
CN 112660456 A 4/2021
DE 3382610 4/1993
DE 29617650 2/1998
DE 69805009 12/2002
DE 69728071 2/2005

(56) References Cited

FOREIGN PATENT DOCUMENTS

| | | |
|---|---|---|
| DE | 102013222924 | 5/2015 |
| DE | 102014103334 | 9/2015 |
| DE | 112013000471 | 4/2016 |
| EP | 0839717 | 5/1998 |
| EP | 1564146 | 8/2005 |
| EP | 3068693 | 1/2019 |
| EP | 3666671 | 6/2020 |
| EP | 3712076 | 9/2020 |
| EP | 3466819 | 11/2020 |
| EP | 3483075 | 12/2020 |
| EP | 3747781 | 12/2020 |
| GB | 885371 | 12/1961 |
| JP | H09110010 | 4/1997 |
| JP | H09240617 | 9/1997 |
| JP | 2000103407 | 4/2000 |
| JP | 2016537272 | 12/2016 |
| KR | 102267779 | 6/2021 |
| WO | 9815458 | 4/1998 |
| WO | 2009152707 | 12/2009 |
| WO | 2015067444 | 5/2015 |

OTHER PUBLICATIONS

"Notice of Allowance", U.S. Appl. No. 29/812,879, filed Aug. 17, 2023, 6 pages.
"Notice of Allowance", U.S. Appl. No. 17/936,690, filed Nov. 27, 2024, 7 pages.
"Autotool 2000 CPK Operating Instructions", Hellerman Tyton, 106-29006, Apr. 2, 2015, 29 pages.
"Extended European Search Report", EP Application No. 20198300.4, May 20, 2021, 11 pages.
"Extended European Search Report", EP Application No. 18192166.9, Jan. 15, 2019, 5 pages.
"Final Office Action", U.S. Appl. No. 16/120,926, filed Feb. 17, 2022, 13 pages.
"Final Office Action", U.S. Appl. No. 16/120,926, filed Nov. 15, 2021, 18 pages.
"Foreign Office Action", CN Application No. 201811167015.1, Dec. 11, 2020, 14 pages.
"Foreign Office Action", CN Application No. 201811344796.7, Jun. 28, 2020, 17 pages.
"Foreign Office Action", CN Application No. 201811167015.1, Apr. 24, 2020, 18 pages.
"Foreign Office Action", CN Application No. 202011032227.6, Dec. 16, 2021, 23 pages.
"Foreign Office Action", CN Application No. 202011032227.6, Jun. 7, 2022, 55 pages.
"Foreign Office Action", CN Application No. 202011032227.6, Jun. 7, 2022, 58 pages.
"Foreign Office Action", CN Application No. 201811344796.7, Jan. 26, 2021, 7 pages.
"Foreign Office Action", CN Application No. 201811167015.1, Jun. 2, 2021, 7 pages.
"Foreign Office Action", CN Application No. 202011032227.6, Nov. 3, 2022, 7 pages.
"Non-Final Office Action", U.S. Appl. No. 16/120,926, filed May 27, 2020, 13 pages.
"Non-Final Office Action", U.S. Appl. No. 16/163,677, filed Jun. 1, 2020, 14 pages.
"Non-Final Office Action", U.S. Appl. No. 16/163,677, filed Jun. 10, 2022, 15 pages.
"Non-Final Office Action", U.S. Appl. No. 16/163,677, filed Dec. 7, 2021, 19 pages.
"Non-Final Office Action", U.S. Appl. No. 17/009,628, filed Nov. 29, 2021, 20 pages.
"Non-Final Office Action", U.S. Appl. No. 17/009,628, filed Mar. 11, 2022, 23 pages.
"Non-Final Office Action", U.S. Appl. No. 18/049,821, filed Mar. 31, 2023, 9 pages.
"Notice of Allowance", U.S. Appl. No. 16/163,677, filed Aug. 25, 2022, 11 pages.
"Notice of Allowance", U.S. Appl. No. 17/009,628, filed Jul. 29, 2022, 8 pages.
"Partial European Search Report", EP Application No. 20198300.4, Feb. 18, 2021, 12 pages.
"Today's Mechanisms Mini Test", 4CR—Technological Studies—Retrieved at: gwcts3.blogspot.com/2011/09/todays-mechanisms-mini-test.html—on Nov. 19, 2021, Sep. 16, 2011, 3 pages.
Hellermantyton, , "EVO 7 Series & 7i Series Nosepiece, 1/Pkg", Retrieved at: https://www.hellermanntyton.us/products/110-70011/—on Mar. 30, 2022, 1 page.
Hellermantyton, , "EVO 7 Series & 7i Series Nosepiece, 1mm tail, 1/pkg", Retrieved at: https://www.hellermanntyton.us/products/110-70131/—on Mar. 30, 2022, 1 page.
Hellermantyton, , "EVO 7 Series & 7i Series Nosepiece, 2mm tail, 1/pkg", Retrieved at: https://www.hellermanntyton.us/products/110-70132/—on Mar. 30, 2022, 1 page.
Hellermantyton, , "EVO 7 Series & 7i Series Nosepiece, 3mm tail, 1/pkg", Retrieved at: https://www.hellermanntyton.us/products/110-70133/—on Mar. 30, 2022, 1 page.
Hellermantyton, , "EVO 9 and EVO 9i 2mm Nosepiece, Extended Tail, 1/pkg", Retrieved at: https://www.hellermanntyton.us/products/110-80064/—on Mar. 30, 2022, 1 page.
Hellermantyton, , "EVO 9 and EVO 9i 3mm Nosepiece, Extended Tail, 1/pkg", Retrieved at: https://www.hellermanntyton.us/products/110-80065/—on Mar. 30, 2022, 1 page.
Hellermantyton, , "EVO 9 and EVO 9i 4mm Nosepiece, Extended Tail, 1/pkg", Retrieved at: https://www.hellermanntyton.us/products/110-80066/—on Mar. 30, 2022, 1 page.
Hellermantyton, , "EVO 9 and EVO 9i 5mm Nosepiece, Extended Tail, 1/pkg", Retrieved at: https://www.hellermanntyton.us/products/110-80067/—on Mar. 30, 2022, 1 page.
Hellermantyton, , "EVO 9 Nosepiece Flush Cut, Replacement Part, 1/pkg", Retrieved at: https://www.hellermanntyton.us/products/110-80018/—on Mar. 30, 2022, 1 page.
Pishehvari, Bergische et al., "Ego-pose estimation via Radar and Openstreetmap-based Scan matching", May 2018, 8 pages.
"Extended European Search Report", EP Application No., Apr. 25, 2024, 6 pages.
"Foreign Office Action", EP Application No. 20198300.4, Jun. 2, 2025, 4 pages.
"Search Report", DE Application No. 202022106860.7—Translation not available, Nov. 15, 2023, 5 pages.
"Non-Final Office Action", U.S. Appl. No. 17/936,690, filed Sep. 6, 2024, 11 pages.
"Notice of Allowance", U.S. Appl. No. 17/664,560, filed Sep. 27, 2024, 9 pages.
"Restriction Requirement", U.S. Appl. No. 17/664,560, filed Jul. 15, 2024, 6 pages.
"Foreign Office Action", CN Application No. 202310403137.0, Jul. 15, 2025, 11 pages.
"Non-Final Office Action", U.S. Appl. No. 18/481,828, filed Aug. 27, 2025, 14 pages.
"Extended European Search Report", EP Application No. 22198311.7, Mar. 13, 2023, 8 pages.
"Non-Final Office Action", U.S. Appl. No. 29/812,879, filed May 8, 2023, 5 pages.
"Notice of Allowance", U.S. Appl. No. 18/481,828, filed Jan. 14, 2026, 11 pages.
"Foreign Office Action", CN Application No. 202311301899.6, Jan. 14, 2026, 13 pages.

* cited by examiner

AUTOMATIC BUNDLING TOOL DEVICE

INCORPORATION BY REFERENCE

This application claims priority to German Patent Application No. DE202022102045.0, filed Apr. 14, 2022, the disclosure of which is incorporated by reference in its entirety.

BACKGROUND

Typically, in an application cycle of an automatic bundling tool device, a one-piece-tie, also often referred to as a cable tie, is moved in guiding rails of a guiding device, which define a closed path around the bundle good or bundled material. When pushed forward by a pushing device, the one-piece-tie forms a loop around the bundle good to be bundled with the one-piece-tie. In this process, the tip of the band part arranged at one band part end of the OPT is usually guided by narrowing guiding rails towards a head part of the OPT, which is arranged at the other band part end of the OPT, and then pushed through a through-opening of the OPT head part, the through-opening often referred to as a window. A tensioning device then grips the OPT band part end which has been pushed through the window and tensions the OPT around the bundle good by pulling the OPT band part end that has passed through the window in a tensioning direction. Usually, the OPT band part end that protrudes over the head part after tensioning is cut off with a cutting device.

In the usual one-piece-ties, the head part has a latching claw which latches onto the band part of the OPT with corresponding latching teeth and thus prevents the band part from being pulled out of the window after tensioning (against the tensioning direction) and thus from being pulled back. This ensures that the OPT remains closed and the bundled goods remain tightened as desired.

With some of the available automatic bundling tools, for example the HellermannTyton Autotool 2000 CPK, it is possible to (indirectly) adjust the force applied for the tensioning, a tensioning force, by influencing a motor current of a tensioning motor associated with the tensioning. For this purpose, during tensioning by the tensioning device, a tensioning gearwheel is brought into engagement with its teeth in the detent teeth of the band part, whereby the tensioning motor assigned to tensioning, for example a step motor or a pulse-controlled DC motor, drives the tensioning gearwheel. The tensioning motor is controlled independently of the other application cycle. This is done by an electronic control unit (ECU) of a control device, which regulates motor speed and/or motor current, e.g. monitors, adjusts and, if necessary, limits or increases it. This can be done, for example, as a function of user input via an input unit of the control device. By controlling the motor speed and/or motor current, the tensioning force can be indirectly checked by using the previously known mathematical relationship between the measured motor current, the resulting torque on the tensioning gear and the force transmitted to the band part.

Some of the available automatic bundling tool devices, including the HellermannTyton Autotool 2000 CPK, also use the control device with the ECU for other applications: For example, it can be set so that:

- the one-piece-tie is not completely closed, e.g. not tensioned with a significantly non-zero tensioning force, in order to create a loose loop of predetermined size, e.g. for sensitive bundles or loose bundles;

- to create a loop with the OPT band part end protruding from the window with a defined length, by the tensioning gear running backwards after tensioning and before cutting off the OPT band part end, thus the tensioning gear ejecting a part of the OPT band part end that was pushed through the window again;
- the protruding OPT band part end is not cut off at all after tensioning by completely ejecting the OPT band part end before cutting in the application cycle; or
- a combination of the above or other possibilities is implemented.

Exemplary automatic bundling tool devices are described in EP 3 466 819 B1, EP 3 483 075 B1, EP 3 068 693 B1, WO 2015 067 444 A1, US 2017/334587 A1 or CN 108 791 998 B.

Two problems are of particular relevance here: On the one hand, OPT can tear due to a tension force that is set too high, and on the other hand, the head part of the OPT can be defective. The latter can be caused, for example, by insufficient stability of the latching claw, whether due to production defects or other properties of the OPT such as excessive humidity or temperature.

In case of tearing, the OPT cannot be tensioned any further and the bundle good is immediately loose, e.g. no longer held together. Such a failure can be easily detected. During tensioning, the motor current increases as the end of the strap is pulled through the window until the set maximum value is reached. If the OPT breaks, on the one hand the set maximum value will not be reached and on the other hand the motor current will suddenly drop, namely at the time of breaking, since no tensioning force and thus no torque has to be applied any more. Accordingly, the control device can output a quality check signal in the form of an error message and stop further processing.

The situation is more difficult with a defective head part. Since the tensioning force to be applied is practically independent of the condition of the latching or detent claw, the motor current/tensioning distance relation with a defective latching claw, e.g. the relation between the applied motor current and the distance covered by the OPT band part end during tensioning, will essentially be the same as the motor current/tensioning distance relation with a functioning latching claw. Accordingly, monitoring the motor current will not give any indication of a fault even if the OPT cannot maintain the tensioning force permanently.

In production processes, for example the production of cable harnesses, both errors can cause great difficulties as they directly influence process stability and product quality. This is especially true for automated applications, where the additional process step of a manual inspection becomes necessary as a result.

SUMMARY

Aspects of the present disclosure are thus based on the task of improving production processes in which automatic bundling tool devices bundle a good by means of one-piece-ties, and in particular, improving process stability and product quality with the same effort or maintaining them with a decreasing effort.

One aspect relates to an automatic bundling tool, or ABT, for bundling a bundle good or bundled material with a one-piece-tie, OPT. In the context of the present disclosure, OPTs are a generalised concept of a standard cable tie. Such a standard cable tie has a cable tie head part with a window, and a cable tie band or strap with an end part that is slid through the window to form a loop that can be used to bundle cables or the like. One-piece-ties or one-piece-fixing-ties (OPTs) further comprise a neck part connecting a foot part to the head part, the foot part comprising an additional fastening means, for example a mushroom-head part, which can be used to fasten the OPT to an object, in the example of the mushroom-head part usually in a hole of the object. The shape or geometry of the OPT can accordingly have a complexity significantly beyond the standard geometry of standard cable ties due to the different possible foot parts.

The bundling tool device may also be referred to as a bundling tool, and the one-piece-tie may also be referred to as a cable tie. The ABT has a guiding device which is configured to guide an OPT band part end, a cable tie band end, around the bundle good through a through-opening, referred to as a window, in an OPT head part. For this purpose, the guiding device may comprise corresponding guiding rails adapted to the used OPT. The ABT also has a tensioning device which is designed i) to tension the OPT by pulling the end of the OPT band part guided through the window in a tensioning direction and ii) to push the end of the OPT band part against the tensioning direction after the OPT has been tensioned. Here, the tensioning direction can correspond to a forward direction of an associated tensioning motor, and the push direction opposite to the tensioning direction can correspond to a backward direction of the tensioning motor.

Part of the ABT is a control device which is designed i) to determine or quantify a characteristic parameter for the pushing of the OPT band part end against the tensioning direction and ii) to output a quality check signal as a function of the characteristic parameter for the pushing against the tensioning direction and a reference value predetermined for the characteristic parameter.

The determining and outputting can be referred to as a quality test cycle or be part of such a quality test cycle. In the quality test cycle, two cases can occur and be identified by the control device on the basis of the determined parameter: case a) of a fault-free head part with a correctly latching claw, and case b) of a faulty head part with a non-latching or unreliable latching claw. Thus, the quality tested is a product quality, e.g. a quality of the OPTs head part.

In case a), the latching claw properly engages with the OPT band part and thus prevents the band part from slipping through the head part against the tensioning direction. This causes a force to build up when pushing against the tensioning direction, which must be overcome by the tensioning device to move the band part. If the force is overcome, the OPT band part will break out laterally and thus allow the push against the tensioning direction.

In case b), the latching claw is not correctly latched with the OPT band part, so that no force or only a greatly reduced force compared to case a) occurs when pushing against the tensioning direction. Case a) and b) can thus be distinguished on the basis of a characteristic parameter of the tensioning mechanism during the pushing. Consequently, the control device may be configured to determine the characteristic parameter, which is characteristic for the pushing of the OPT band part end, during the pushing, e.g. after the tensioning.

The parameter can therefore be monitored by the control device, which outputs the quality check signal accordingly—be it an OK signal with a continuation of the application cycle or an NOK or warning signal with a stop of the application cycle. The OK signal and/or the warning signal can be a visual and/or acoustic signal and/or an electronic signal intended for a monitoring device.

When continuing the application cycle, after the OPT band part end has been pushed against the tensioning direction, the OPT band part end can be pulled back in the tensioning direction to the starting position before pushing, if required. In this way, a cutting of the OPT band part end provided for in the application cycle can be carried out unaffected by the quality test cycle.

In the approach described here, an already known and available functionality, namely the ejection of the OPT band part end, is used in a new way. By means of the quantified monitored pushing of the OPT band part end back against the tensioning direction, defects that could not be detected automatically so far, namely defective head parts, can be detected. The quality monitoring or inspection takes place "in line" with the tensioning of the OPT, which makes subsequent monitoring steps, such as optical and/or haptic monitoring, superfluous. This results in increased process stability and product quality or eliminates the need for a monitoring step that would otherwise be required after bundling. This can be implemented with a relatively inexpensive firmware update compared to a complete new development of the tools used or additional tools in the application cycle.

In an advantageous embodiment, it is provided that the control device is configured to determine the characteristic parameter for an OPT band part end that has not, in particular not yet, been completely pushed out of the tensioning device. This has the advantage that the further processing of the OPT band part end is not influenced by the determining, since after the determining the OPT band part end can both be pulled again in the tensioning direction and cut off at a desired point, e.g. it can also be completely ejected in order to remain untrimmed.

In a further advantageous embodiment, it is provided that the tensioning device comprises a motor, in particular a tension or drive motor. The motor can be a stepper motor. The tensioning motor can drive a tensioning gear wheel which is configured to engage (preferably in a form fit engagement) with the end of the band part pulled/pushed through the window during tensioning. The characteristic parameter here comprises a motor current of the motor of the tensioning device during pushing or is the motor current during pushing, or is or comprises a variable derived from the motor current of the motor during pushing. This effectively results in an electric power for the pushing is taken into account by the control device. In particular, the characteristic quantity can be or comprise a force derived from the motor current which is required to push the OPT band part end against the tensioning direction after the OPT has been tensioned.

This has the advantage that the characteristic parameter can be determined particularly precisely and easily, since the motor current is already controlled and thus also monitored for tensioning with a predetermined tensioning force during the pulling of the OPT band part end which is guided through the window. The motor current or variables derived from it are thus easy to measure and particularly suitable for monitoring the pushing.

It is particularly advantageous here if the motor is a direct current motor, preferably a direct current motor controlled via a pulse-counting encoder and the tensioning device is configured to control the direct current motor with a predetermined number of n control pulses, which can correspond to n motor steps, when pushing against the tensioning direction. Such a DC motor may be referred to as a pulse-controlled DC motor. Alternatively, the motor can also be a stepper motor. Pushing thus corresponds to control pulses (possibly motor steps) corresponding to the reverse direction of the motor, against the tensioning direction, and pulling corresponds to control pulses (possibly motor steps) in the forward direction of the motor, in the tensioning direction. When using a "normal" DC motor, experience has shown that a sufficiently precise control and thus positioning can already be specified, so that the determined parameter is to be determined sufficiently precise and easy and the quality of the latching in the head part can be reliably checked.

In another advantageous embodiment, it is provided that the control device is configured to determine the characteristic parameter once during the pushing against the tensioning direction. In particular, the characteristic parameter can be determined exactly once or from a single measurement selected from several individual measurements. The determination may refer to a determination for a single point in time as a sufficiently short time interval. Preferably, such a time interval can be predetermined by an (pre-selected) i-th control pulse of the predetermined number of n control pulses, with $0<i<n+1$. This has the advantage that the determination can be carried out mathematically in a particularly simple manner and thus quickly and reliably, with low requirements on the control device used.

In another advantageous embodiment, it is provided that the control device is configured to determine the characteristic parameter for a series of points in time during the pushing against the tensioning direction, and to compare a course of the characteristic parameter with a course of the reference value specified for the characteristic parameter for the output of the quality check signal. This has the advantage that the characteristics of the OPT and the latching of the OPT band part end in the OPT head part can be analysed particularly precisely, and thus a particularly precise statement about the quality of the latching can be made by the control device.

In another advantageous embodiment, it is provided that the control device is configured to determine the characteristic parameter for a predetermined period of time during the pushing against the tensioning direction, in particular for the period of time of a predetermined number of control pulses or motor steps during the pushing or during the entire pushing, with integrating the characteristic parameter or a measured value on which the characteristic parameter is based over the predetermined period of time. This has the advantage that the determining requires little computational effort, but is implicitly averaged over several measurements and thus the reliability is improved compared to a single measurement.

In a further advantageous embodiment, it is provided that the reference value specified for the characteristic parameter, in particular the course of the reference value specified for the characteristic parameter, is automatically specified by the control device itself based on a statistical evaluation of the determined characteristic parameter. In particular, this can be done based on an expected value determined for the characteristic parameter, for example as twice or three times the standard deviation for the characteristic parameter. This has the advantage that the reference value does not have to be calculated and specified manually, but the reference value suitable for the desired confidence value is used automatically, without an operator having to deal more closely with the magnitude of forces occurring in the respective application cycle. The operator then only has to check at the start of production for a statistically significant number of passes through the application cycle, for example 10 or 100 passes, that the desired tensioning force is actually achieved with the loadable latching.

The reference value can also be determined and stored individually for different application cycles. For example, it can be automatically determined for the different positions on a product at which a respective OPT is used which reference value applies there. In conjunction with the described automatic specification of the reference value, a robust and decentralised monitoring of the tensioning force actually achieved via the loadable latching in the different positions in the work process is thus achieved.

In a further advantageous embodiment, it is provided that the predetermined reference value is a threshold value and the control device is configured to compare the characteristic parameter with the predetermined threshold value and, in particular, to output a positive quality check signal if the characteristic parameter is greater than the threshold value and/or to output a negative quality check signal if the characteristic parameter is less than the threshold value. Especially when the characteristic parameter is the motor current, it is thus possible to check whether the motor current required for pushing is greater than the threshold value, which is associated with the reliable latching in the head part. This has the advantage that the quality of the latching can be monitored particularly easily and reliably.

In an advantageous embodiment, it is provided that the guiding device has a holding or fixing element which is configured to hold or fix the OPT head part in a predetermined position when the OPT band part end is pushed and thus, when the OPT is fault-free, also fix the OPT head part against the tensioning direction, in particular in the same position as when the OPT is tensioned. The fixing element fixes the head part during pulling and pushing in at least one direction of space, in the tensioning direction and against the tensioning direction. For example, the fixing element can be in the form of a corresponding projection or a fixing claw, which prevents movement of the head part against the tensioning direction, at least for the duration of the push. This has the advantage that a deflection of the head part during the pushing is prevented by design, independent of a contact pressure of the ABT against the bundle good and a stability of the bundle good. This ensures a constant determination of the characteristic parameter and increases the reliability of the quality monitoring.

Another aspect relates to operating the ABT of any one of the described embodiments.

Yet another aspect relates to a method of bundling a bundle good with an OPT or cable tie by an ABT, comprising the steps of:

a) guiding an OPT/cable tie band end around the bundle good and through a window in a head of the OPT/cable tie, by a guiding device of the ABT;
b) tensioning the OPT/cable tie with pulling the OPT/cable tie band end in a tensioning direction, by a tensioning device of the ABT;
c) pushing the OPT/cable tie band end against the tensioning direction after the OPT/cable tie has been tensioned, by the tensioning device of the ABT;
d) determining a force or other characteristic parameter required for pushing the end of the OPT/cable tie against the tensioning direction, by a control device of the ABT; and
e) outputting, by the control means, a quality check signal in dependence on the force or the other characteristic parameter required to push against the tensioning direction and a predetermined reference force or reference value.

As further optional process steps, the following can be carried out:

f1) (Complete) ejection of the OPT/cable tie end without cutting off the OPT/cable tie end, by the tensioning device; or f2) Cutting off the OPT/cable tie band end, preferably after the OPT/cable tie band end has been pulled back to the starting position before being pushed, by a cutting device.

Advantages and advantageous embodiments of the methods correspond to advantages and advantageous embodiments of the automatic bundling tool device.

The features and combinations of features described above, including the general part of the description, as well as the features and combinations or features disclosed in the figure description or the figures alone, may be used not only alone or in the combination described, but also with other features or without some of the disclosed features, without departing from the scope of the present disclosure. Consequently, embodiments that are not explicitly illustrated and described by the figures, but can be produced by separately combining the individual features disclosed in the figures, are also part of the present disclosure. Therefore, embodiments and combinations of features that do not comprise all features of an originally formulated independent claim are to be considered as disclosed. Furthermore, embodiments and combinations of features that deviate from or go beyond the combinations of features described by the dependencies of the claims are considered disclosed.

BRIEF DESCRIPTION OF THE DRAWINGS

Exemplary embodiments are described in more detail below with reference to schematic drawings. Showing.

In the figures, the same or functionally identical features are provided with the same reference signs.

DETAILED DESCRIPTION

The disclosure relates to an automatic bundling tool (ABT), for bundling a bundle good with a one-piece-tie or one-piece-fixing-tie (OPT), comprising a guiding device configured to guide an OPT band part end around the bundle good through a window in an OPT head part, and a tensioning device configured to tension the OPT with pulling, in a tensioning direction, the OPT band part end which is guided through the window and to push the OPT band part end against the tensioning direction after the OPT has been tensioned. Here, one-piece-ties, as a generalised concept of cable ties, include ordinary cable ties.

Figure 1:
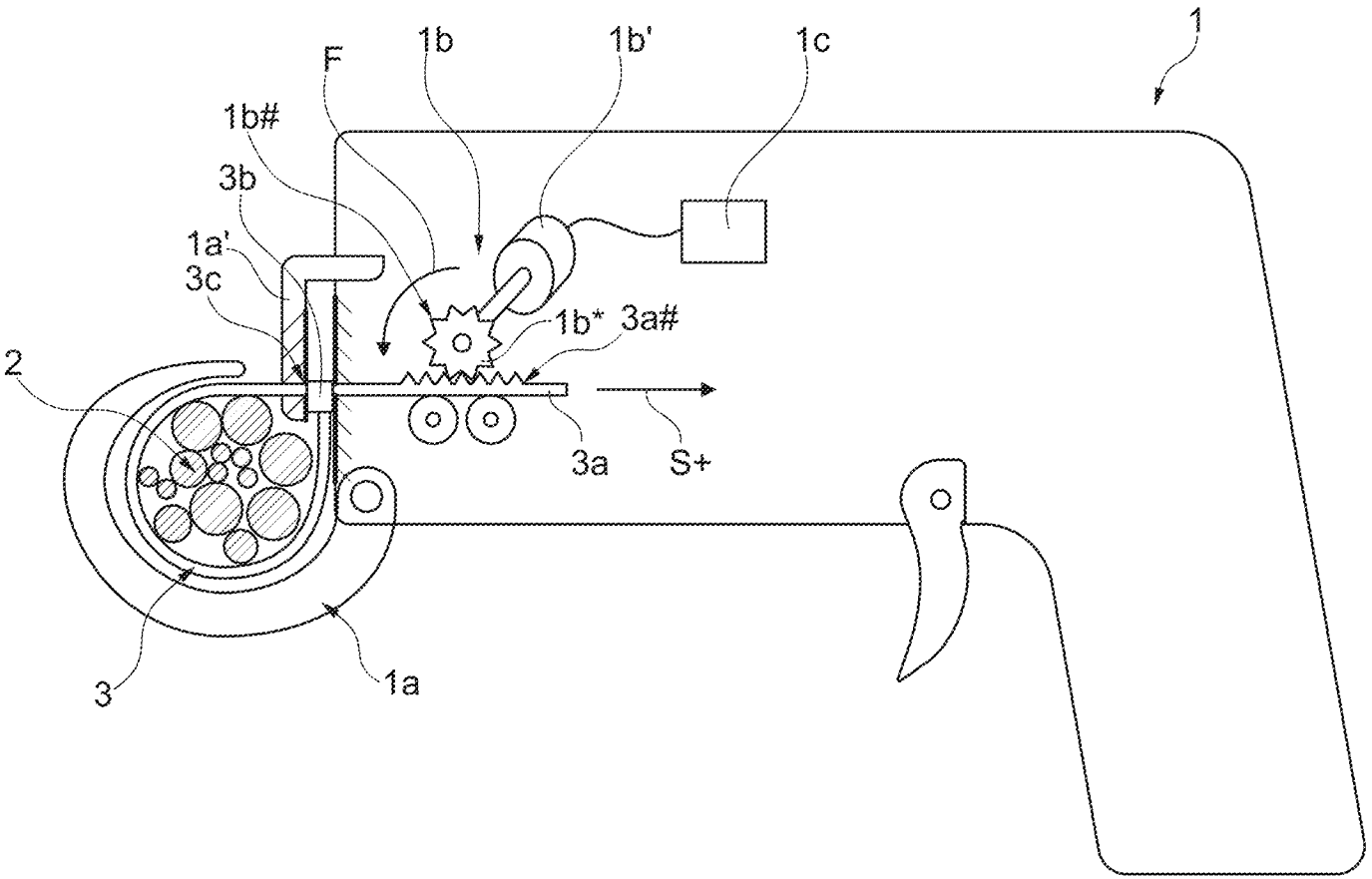
FIG. 1 is a view of an exemplary embodiment of an automatic bundling tool device.

FIG. 1 schematically shows an exemplary embodiment of an automatic bundling tool 1, automatic bundling tool, ABT, for bundling a bundle good 2 with a one-piece-tie 3, OPT. In this example, the OPT is a classic standard cable tie.

The ABT 1 has a guiding device 1*a* which is configured to guide an OPT band part end 3*a* around the bundle good 2 through a window 3*c* in an OPT head part 3*b*. The ABT 1 also has a tensioning device 1*b* which is designed both for tensioning the OPT 3 by pulling the OPT band part end 3*b* guided through the window 3*c* in a tensioning direction S+ and for pushing the OPT band part end 3*a* against the tensioning direction, e.g. in a pushing direction S− (FIGS. 2 and 3) after the OPT 3 has been tensioned. Furthermore, the ABT 1 also has a control device 1*c* which, on the one hand, is configured to determine a characteristic parameter for the pushing of the OPT band part end 3*a* against the tensioning direction S+ and, on the other hand, to output a quality check signal as a function of the characteristic parameter for the pushing against the tensioning direction S+ and a reference value predetermined for the characteristic parameter.

In the example shown, the tensioning device 1*b* comprises a motor 1*b*', here a stepper or pulse motor, which drives a tensioning gear wheel 1*b. The tensioning gear wheel 1*b engages with its teeth 1*b*# in detent teeth 3*a*# of the OPT band part end 3*a* and thus enables tensioning of the OPT 3 in the tensioning direction S+ when the motor 1*b*' rotates in the forward direction F and pushing of the OPT 3 in the pushing direction S− against the tensioning direction S+ when the motor 1*b*' rotates in the reverse direction R (FIGS. 2 and 3).

The characteristic parameter for the pushing is accordingly a motor current of the motor 1*b*' here, which is regulated by the control device 1*c* and determined during the pushing. As explained in FIGS. 2 and 3, the motor current is equivalent to the force required for the pushing.

In order to determine the force required for the pushing particularly reliably on the basis of the motor current, the guiding device 1*a* in this example also has a holding element 1*a*', which is designed as a push-counter-hold in order to prevent movement of the OPT head part 3*b* during the pushing in the pushing direction S−. For this purpose, the holding element 1*a*' holds the OPT head part 3*b* in a (unchangeably) predetermined position.

Figure 2:
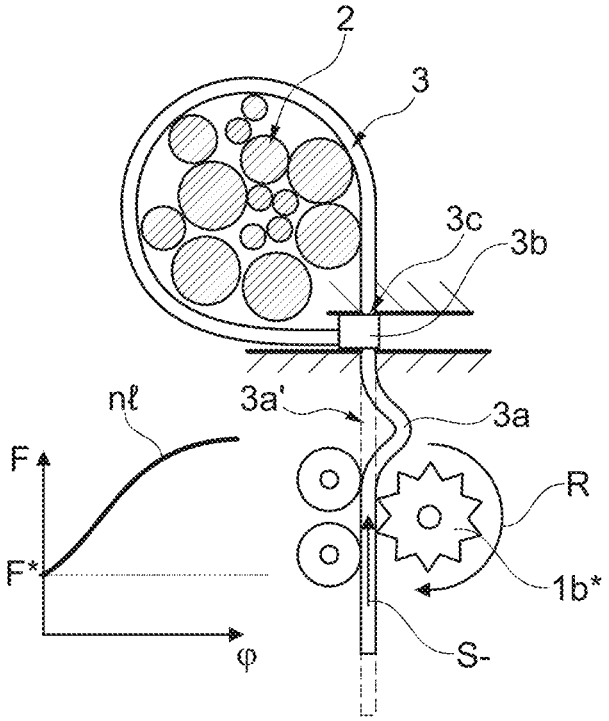
FIG. 2 is a view of the tensioning device of the automatic bundling tool device of FIG. 1 when pushing an OPT band part end with defect-free OPT head part.
Figure 3:
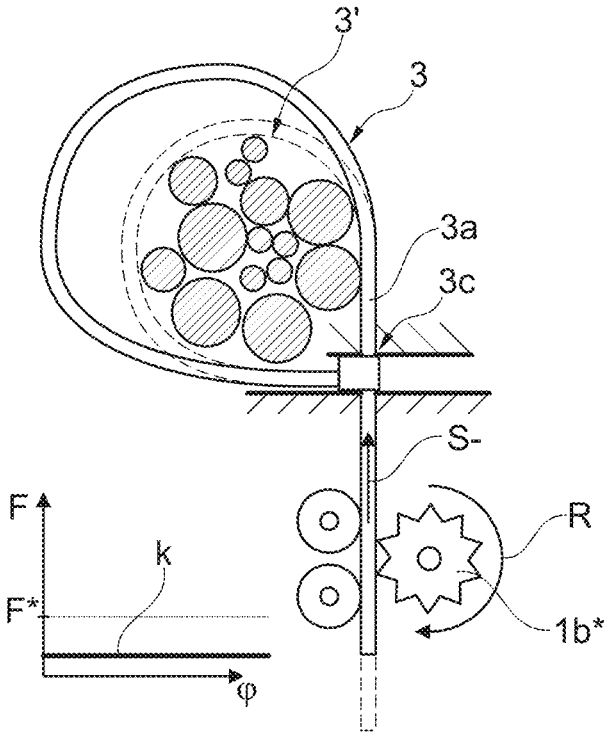
FIG. 3 is a view of the tensioning device of the automatic bundling tool device from FIG. 1 when pushing an OPT band part end with defective OPT head part.

FIG. 2 shows an example of the case of a fault-free OPT head section 3*b* during pushing. Since the latching in the OPT head part 3*b* functions reliably here, the OPT band part end 3*a* moves laterally out of the original position 3*a*' when the motor 1*b*' and thus the tensioning gear wheel 1*b rotate in the reverse direction R and thus push the OPT band part end 3***a* in the push direction S−.

Since the lateral deflection is accompanied by a considerable deformation of the OPT 3, a force F must be applied to push the end of the OPT band part 3*a* in the direction of pushing S−. This force F is shown in FIG. 2 in an exemplary course for a defect-free OPT head part 3*b* over the angle of rotation φ of the tensioning gear wheel 1*b. The angle of rotation φ thus corresponds to a path length for the OPT band part end 3***a* pushed in the direction of pushing S. The force F to be applied by the motor 1*b*' for the pushing is greater than a force threshold value F*. In the example shown, it has the non-linear course increasing monotonically with rotation angle φ illustrated by curve nl (nℓ).

The force F to be applied is therefore a possible characteristic parameter for the pushing. Since the force F to be applied and the motor current are directly related, the motor current is also a characteristic parameter for the pushing. The motor current can in turn be easily determined by the control device 1*c* and is therefore particularly suitable for checking the quality of the latching in the OPT head part 3*b*.

FIG. 3 shows an example of the case of a faulty OPT head part 3*b* during the pushing. Since the latching in the OPT head part 3*b* does not function here, the OPT band part end 3*a* does not deflect sideways, in contrast to the case of reliable latching. Rather, when motor 1*b*' and thus tensioning gear 1*b rotate in reverse direction R and thus push the OPT band part end 3***a* in push direction S−, the OPT band part end 3*a* is pushed back through window 3*c*. This means that the OPT 3 is no longer tensioned in the original position 3' on the bundle good 2, and the bundle good 3 is not properly bundled.

The pushing of the OPT band part end 3*a* in pushing direction S− back through the window 3*c* is not connected with any considerable deformation of the OPT 3, so that only a very small constant force F has to be applied for the pushing of the OPT band part end 3*a* in pushing direction S−. In the example shown, it has the constant course shown by curve k.

The force threshold value F* can thus easily be selected in such a way that during the pushing in pushing direction S− the control device can reliably distinguish between a faulty head part with non-functioning latching and a fault-free head part with functioning latching. Thus, the motor current determined during the pushing, which corresponds to the applied force F, can be compared as a characteristic parameter with a motor current threshold value, which in turn corresponds to the force threshold value F*. If the determined motor current is greater than the motor current threshold value, the latching is fault-free and a positive ("OK") quality check signal can be output. If the determined motor current is less than the motor current threshold value, the latching is faulty and a negative ("not OK", NOK) quality check signal can be output.

Unless context dictates otherwise, use herein of the word "or" may be considered use of an "inclusive or," or a term that permits inclusion or application of one or more items that are linked by the word "or" (e.g., a phrase "A or B" may be interpreted as permitting just "A," as permitting just "B," or as permitting both "A" and "B"). Also, as used herein, a phrase referring to "at least one of" a list of items refers to any combination of those items, including single members. For instance, "at least one of a, b, or c" can cover a, b, c, a-b, a-c, b-c, and a-b-c, as well as any combination with multiples of the same element (e.g., a-a, a-a-a, a-a-b, a-a-c, a-b-b, a-c-c, b-b, b-b-b, b-b-c, c-c, and c-c-c, or any other ordering of a, b, and c). Further, items represented in the accompanying figures and terms discussed herein may be indicative of one or more items or terms, and thus reference may be made interchangeably to single or plural forms of the items and terms in this written description.

What is claimed is:

1. An automatic bundling tool device (ABT) for bundling a bundle good with a one-piece-tie (OPT) including a one-piece-tie (OPT) band part end and a one-piece-tie (OPT) head part, the ABT comprising:

a guiding device defining a path configured to guide the OPT band part end around the bundle good through a window in the OPT head part;

a tensioning device comprising a gear wheel configured to engage the OPT band part end and configured to tension the OPT, with a pulling of the OPT band part end that is guided through the window in a tensioning direction, the tensioning device further configured to push the OPT band part end against the tensioning direction in a pushing direction after the OPT has been tensioned; and a control device configured to determine a force or other characteristic parameter for the pushing of the OPT band part end against the tensioning direction and output a quality check signal as a function of the force or the other characteristic parameter and a reference force or reference value predetermined for the force or the other characteristic parameter.

2. The ABT according to claim 1, wherein the control device is further configured to determine the characteristic parameter for the pushing of an OPT band part end that is not completely pushed out of the tensioning device.

3. The ABT according to claim 1, wherein the tensioning device further comprises a motor, and the characteristic parameter comprises at least one of:

a motor current of the motor of the tensioning device; or a variable derived from the motor current of the motor of the tensioning device.

4. The ABT according to claim 1, wherein the tensioning device further comprises a pulse-controlled direct current motor, the characteristic parameter comprises a motor current of the pulse-controlled direct current motor, and the tensioning device is configured to control the pulse-controlled direct current motor with a predetermined number of control pulses while pushing against the tensioning direction.

5. The ABT according to claim 1, wherein the tensioning device further comprises a motor, the characteristic parameter comprises a variable derived from a motor current of the motor of the tensioning device, and the variable derived from the motor current of the motor comprises a force that is required to push the OPT band part end against the tensioning direction after tensioning of the OPT has taken place.

6. The ABT according to claim 1, wherein the control device is configured to determine the characteristic parameter once during the pushing against the tensioning direction.

7. The ABT according to claim 6, wherein the tensioning device further comprises a pulse-controlled direct current motor, the characteristic parameter comprises a motor current of the pulse-controlled direct current motor, the tensioning device is configured to control the pulse-controlled direct current motor with a predetermined number of control pulses while pushing against the tensioning direction, and the characteristic parameter is determined for an i-th control pulse of the predetermined number of n control pulses, with $0<i<n+1$.

8. The ABT according to claim 1, wherein the control device is further configured to determine the characteristic parameter for a series of times during the pushing against the tensioning direction, and compare a course of the characteristic parameter with a course of the reference value predetermined for the characteristic parameter for the outputting of the quality check signal.

9. The ABT according to claim 1, wherein the control device is further configured to determine the characteristic parameter for a predetermined period of time during the pushing against the tensioning direction.

10. The ABT according to claim 9, wherein the control device is further configured to determine the characteristic parameter for at least one of:

a period of time of a predetermined number of motor steps during the pushing against the tensioning direction, with integrating of the characteristic parameter or a measured value on which the characteristic parameter is based on, over the predetermined period of time; or a period of time of a predetermined number of motor steps during the entire pushing against the tensioning direction, with integrating of the characteristic parameter or a measured value on which the characteristic parameter is based on, over the predetermined period of time.

11. The ABT according to claim 1, wherein the reference value predetermined for the characteristic parameter is predetermined by the control device based on a statistical evaluation of the determined characteristic parameter.

12. The ABT according to claim 1, wherein a course of the reference value predetermined for the characteristic parameter is predetermined by the control device based on a statistical evaluation of the determined characteristic parameter.

13. The ABT according to claim 1, wherein a course of the reference value predetermined for the characteristic parameter is predetermined by the control device based on an expected value for the characteristic parameter.

14. The ABT according to claim 13, wherein the expected value for the characteristic parameter two or three times a standard deviation for the characteristic parameter.

15. The ABT according to claim 1, wherein the predetermined reference value is a predetermined threshold value, and the control device is configured to compare the characteristic parameter with the predetermined threshold value to output at least one of:

a positive quality check signal if the characteristic parameter is greater than the threshold value; or a negative quality check signal if the characteristic parameter is less than the threshold value.

16. The ABT according to claim 1, wherein the guiding device comprises a holding element configured to hold the OPT head part in a predetermined position when the OPT band part end is pushed against the tensioning direction.

17. The ABT according to claim 16, wherein the holding element is configured to hold the OPT head part in the predetermined position when the OPT band part end is pushed against the tensioning direction in the same position as when the OPT is tensioned.

18. A method of bundling a bundle good with a one-piece-tie (OPT) by an automatic bundling tool device (ABT) comprising:

guiding a one-piece-tie (OPT) band end around the bundle good and through a window in a head of the OPT, by a guiding device of the ABT;

tensioning the OPT with pulling the OPT band end in a tensioning direction, by a tensioning device of the ABT;

pushing the OPT band end against the tensioning direction after the OPT has been tensioned, by the tensioning device of the ABT;

determining a force or other characteristic parameter required for pushing the end of the OPT against the tensioning direction, by a control device of the ABT; and outputting, by the control device, a quality check signal in dependence on the force or the other characteristic parameter required to push against the tensioning direction and a predetermined reference force or reference value.

19. The method according to claim 18, further comprising at least one of:

ejecting the OPT band end without cutting off the OPT band end, by the tensioning device; or cutting off the OPT band end, by a cutting device.

20. The method according to claim 18, further comprising cutting off the OPT band end, by a cutting device, wherein cutting off the OPT band end is performed after the OPT band end has been pulled back to a starting position before being pushed.

* * * * *